US006739129B2

(12) United States Patent
Heusser et al.

(10) Patent No.: US 6,739,129 B2
(45) Date of Patent: May 25, 2004

(54) ELECTROHYDRAULIC MOTOR PUMP AGGREGATE, ATTACHABLE ELEMENT AND PRESSURE LIMITING VALVE

(75) Inventors: Martin Heusser, Munich (DE); Gerhard Lörner, Eching (DE)

(73) Assignee: Heilmeier & Weinlein Fabrik F. Oel-Hydraulik GmbH & Co. KG (DE)

( * ) Notice: Subject to any disclaimer, the term of this patent is extended or adjusted under 35 U.S.C. 154(b) by 0 days.

(21) Appl. No.: 10/265,898

(22) Filed: Oct. 7, 2002

(65) Prior Publication Data

US 2003/0070428 A1 Apr. 17, 2003

(30) Foreign Application Priority Data

Oct. 15, 2001 (DE) ..... 201 16 921 U

(51) Int. Cl.[7] ..... F04B 23/00
(52) U.S. Cl. ..... 60/468; 60/486; 91/437
(58) Field of Search ..... 60/468, 486, 494; 91/437

(56) References Cited

U.S. PATENT DOCUMENTS 4,197,705 A 4/1980 Westveer ..... 60/494
4,362,084 A 12/1982 Walters
4,694,649 A * 9/1987 Howeth ..... 60/468
5,454,223 A 10/1995 Tschida et al.
6,524,084 B2 * 2/2003 Neumair ..... 417/372
2001/0028850 A1 10/2001 Neumair

FOREIGN PATENT DOCUMENTS

DE 200 07 554 U1 9/2000

* cited by examiner

*Primary Examiner*—Thomas E. Lazo
(74) *Attorney, Agent, or Firm*—Cook, Alex, McFarron, Manzo, Cummings & Mehler, Ltd.

(57) ABSTRACT

An electromotor M of a electrohydraulic motor pump aggregate G drives at least one pump stage P, P1, P3. An attached element C is inserted between at least one pressure side port of the pump stage, a return line 13, and at least one consumer port A, B, 5, 6. A multiways control valve 3 is installed between the consumer port and the pressure side port. A pressure limiting valve R1, R2 constructed as a seated valve is installed between the consumer port A, B, 5, 6 and the return line 13. The motor pump aggregate G has an automatic hydraulic pressure relieving device D for relieving the system pressure whenever the electromotor M is switched off.

12 Claims, 2 Drawing Sheets

Figure 1:
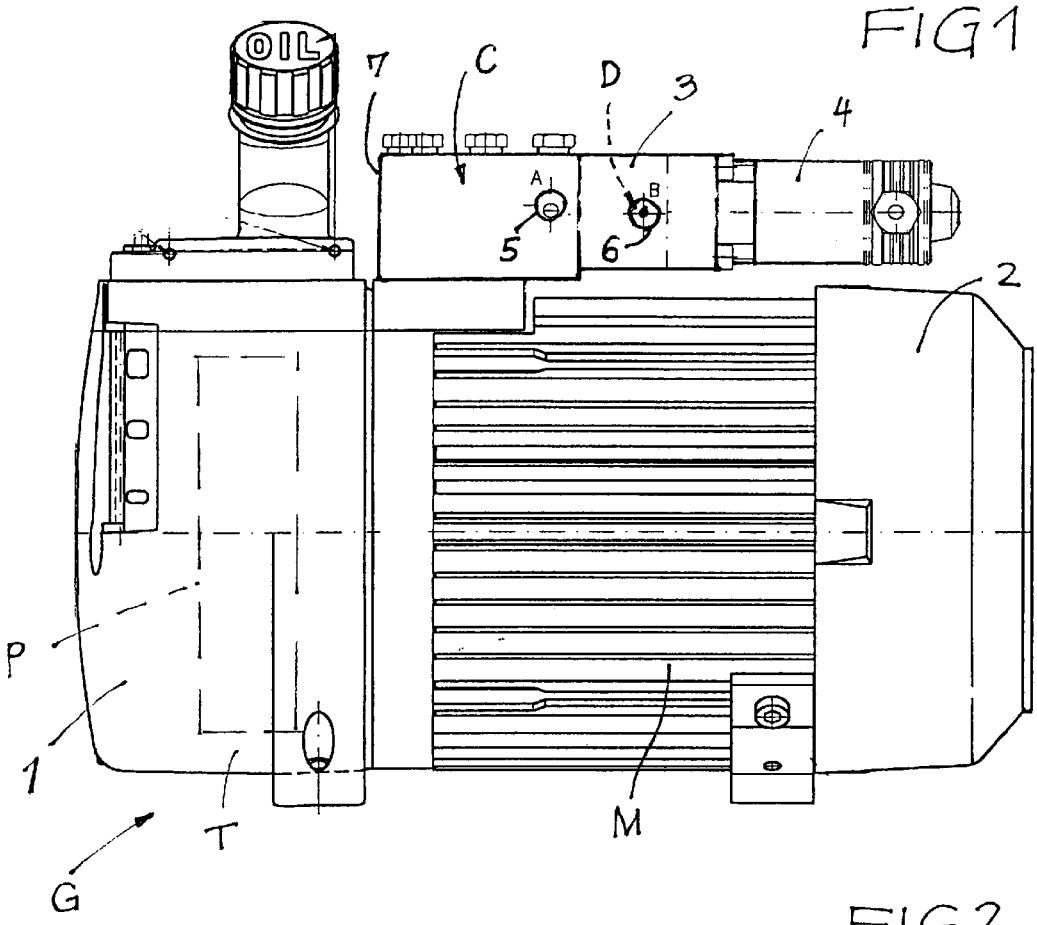

ELECTROHYDRAULIC MOTOR PUMP AGGREGATE, ATTACHABLE ELEMENT AND PRESSURE LIMITING VALVE

The invention relates to an electrohydraulic motor pump aggregate, to an attachable element and to a pressure limiting valve.

Electrohydraulic motor pump aggregates according to DE 200 07 554 U are employed e.g. in tooling machines for controlling the actuation of hydro-mechanic clamping devices or tool clamping devices or work piece holding devices. Moreover, electrohydraulic motor pump aggregates are used as portable supply units for cutting apparatuses or riveting devices, for tools or for screwing tools. The motor pump aggregate is equipped with an attached element provided with at least one consumer port to which the respective consumer is connected, e.g. via hydraulic tubes or pipings. When the motor pump aggregate is switched off a considerable system pressure will be maintained for longer time due to the high tightness of the valve components and also because of the manufacturing precision connected to hydraulic consumers. Particularly in case of transportable electrohydraulic motor pump aggregates intended to generate maximum pressures up to 800 bars the pressure maintaining property may constitute an undesirable drawback of the high quality of the co-operating hydraulic components, and particularly in case of electrohydraulic motor pump aggregates equipped with an electric AC-motor. Particularly in case of an AC-motor maintained pressure of considerable magnitude complicates the restart after an interruption of the operation. Furthermore, tube couplings or piping couplings hardly can be separated. The hydro-consumer, as long as it is connected to the aggregate, cannot be returned manually even though this might be desirable for a certain reason. A main reason for the long time-pressure maintaining property is that the respective valve components provide leakage free blocking positions. Particularly pressure limiting valves constructed as seated valves are completely free of leakage in the blocking position. On the other hand, leakage free valve components are a must for operating pressures up to 800 bars in order to reach the operating pressure reliably and rapidly with a AC-motor and a small flow rate of the high pressure pump stage.

In hydraulic control systems according to U.S. Pat. No. 4,197,705 A or U.S. Pat. No. 5,454,223 A which are supplied by a regulated variable displacement pump the discharge volume and/or the discharge flow of which is regulated depending on the load, i.e., depending on the pressure demand. A restart of the electromotor after a standstill period only does not cause problems, if all directional control valves are switched into the neutral position, because then a substantially pressureless circulation flow path is open to the tank. The variable displacement pump is adjusted by spring load for maximum discharge volume when restarting. Since the flow resistance of the substantially pressureless circulation flow path is low, no excessive restarting current is needed if the drive motor of the variable displacement pump is an electromotor. However, if one of the directional control valves still is in a control position after a standstill period, then the pressureless circulation flow path is blocked. The variable displacement pump, adjusted by spring load for maximum discharge volume, then has to discharge counter to a considerable flow resistance resulting in an excessive restarting current for the electromotor driving the variable displacement pump.

Further prior art is contained in U.S. Pat. No. 4,362,084 A.

It is an object of the invention to provide a hydraulic motor pump aggregate of the kind as disclosed in which, in a structurally simple way, the long time pressure maintaining property of the hydraulic valve components is eliminated, further to provide an attachable property of the hydraulic valve components is eliminated, further to provide an attachable element for a hydraulic pump aggregate particularly operated by an AC-motor, by which attachable element restart problems of the AC-motors can be avoided, and finally to provide a pressure limiting valve designed as a seated valve which allows an intended leakage in its blocking position.

The pressure relieving device is automatically relieving the pressure as soon as the electromotor has come to a standstill. This considerably facilitates the restart of the electromotor. The effect is of particular advantage in case of an AC-motor, because, otherwise, a restarting AC-motor would consume a relatively high starting current, which occasionally could overload the fuses or the protections provided in the normal power net. Particularly AC-motors are used in case of transportable motor pump aggregates because then the motor pump aggregate can be connected to the normal electricity net during its mobile application. However, the facilitated restart may be desirable for other types of electromotors as well. As further advantages, hose couplings or piping couplings can be separated without problems after relieving the pressure, and the consumer occasionally can be returned manually which might be of advantage e.g. in case of an accidental current breakdown.

The attachable element can be employed to retrofit a electrohydraulic motor pump aggregate in order to facilitate the restart of the electromotor after a break, e.g. in case of an AC-motor. The permanently open by-pass means only negligible loss. No special valve component is employed for this additional function, but the anyway necessary pressure limiting valve.

Despite its seated valve construction the pressure limiting valve generates in its theoretically leakage free blocking position a leakage of a predetermined magnitude which leakage, however, does not affect the pressure limiting function detrimentally. In this way the first maintained pressure will be relieved within a known time duration and without an additional valve component by the pressure limiting valve itself. This offers advantages in case of an electrohydraulic motor pump aggregate containing an AC-motor as a drive source for the pump stage, in order to keep the restarting current of the AC-motor low.

Expediently, the pressure relieving device is incorporated into the attachable element. The permanently open by-pass means a loss during operation which loss, however, is negligible. The pressure is relieved automatically as soon as the electromotor is switched off.

In order to achieve the desired function of the pressure relieving device without an additional valve component, expediently, the by-pass is provided in one of the pressure limiting valves. During operation the pressure limiting valve fulfils the normal pressure limiting function. At the beginning of an operational break the pressure limiting valve additionally is fulfilling the function of the pressure relief.

In case of an electrohydraulic motor pump aggregate having at least two consumer ports and a pressure limiting valve associated to each port both pressure limiting valves conventionally are set for differing response pressures. Expediently, the by-pass is provided in the pressure limiting valve operating with the lower response pressure to avoid losses during the build-up of the higher operation pressure. The loss caused by the by-pass is without importance during a return stroke or release stroke of a hydraulic consumer as controlled by the motor pump aggregate.

An AC-motor used as the electromotor has the advantage to be connectable to the normal AC-electricity net. The dual circuit pump stage allows to first rapidly reach a low pressure level by the lower pressure pump stage and with a relatively high flow rate, and then to reach a very high operational pressure, e.g. up to about 800 bars with the high pressure pump stage but with a small flow rate. The directions of movement of the hydraulic consumer are controlled by means of the multi-ways control valve, while each pressure limiting valve is limiting the maximum operational pressure in one direction of movement. In order to achieve the pressure relieving function the by-pass is provided in one of the pressure limiting valves, expediently in the pressure relieving valve provided for a function of less importance or for limiting a lower pressure.

In a structurally simple way the by-pass is formed in a seated cone valve by a flat surface in the cone jacket of the valve cone. In the blocking position of the pressure limiting valve the flat surface forms a passage or a throttle opening of a predetermined size with the valve seat through which passage or throttle opening the leakage will flow away. Expediently the flat surface is formed by a ground surface which is easy to manufacture.

The flat surface should be located parallel to the generatrice of the cone such that it can be formed precisely during the grinding strokes when grinding the cone jacket, particularly by once interrupting the rotational movement of the valve cone and by an additional positive inward adjustment of the grinding tool.

Alternatively, the by-pass could be formed in seated cone valve or a seated ball valve by at least one notch formed in the valve seat itself.

Expediently the by-pass is dimensioned such that it generates a leakage flow of about 0.3 to 0.4 liter per minute at a reference pressure of 150 bars. In this way a substantial pressure relieve can be carried out within a few seconds, e.g. within 5 seconds.

It is expedient to form the valve cone with a damping piston in order to avoid a nervous response behaviour of the pressure limiting valve.

The damping effect can be increased by an outwardly open cavity of the damping piston, a channel, and integrated a check valve.

Figure 2:
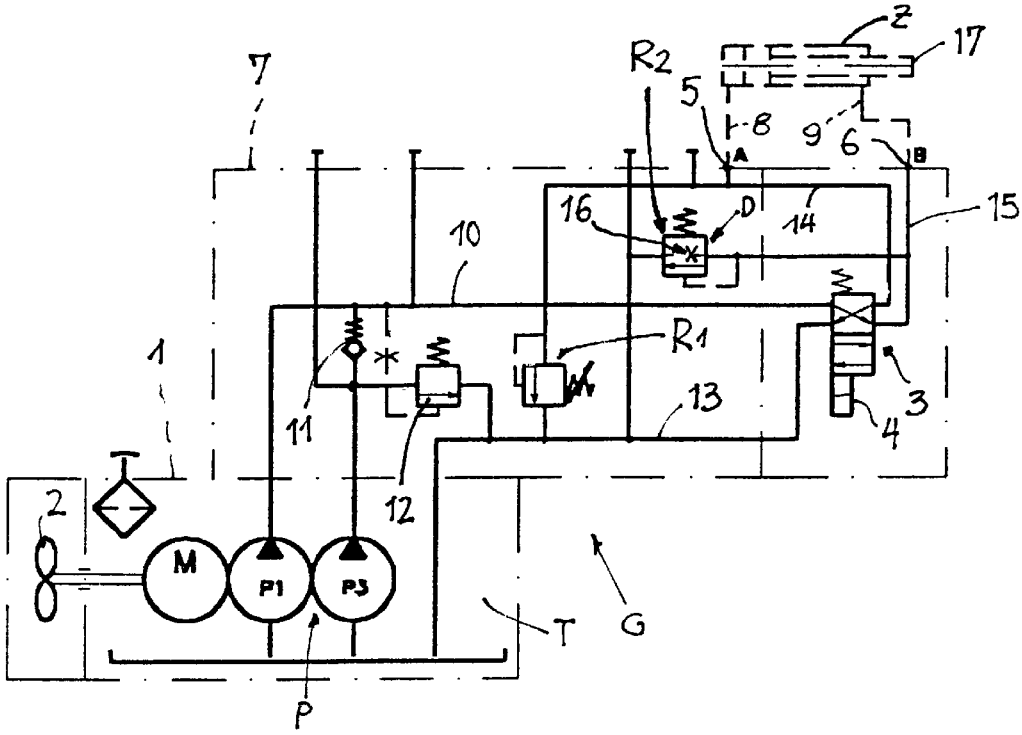
Figure 3:
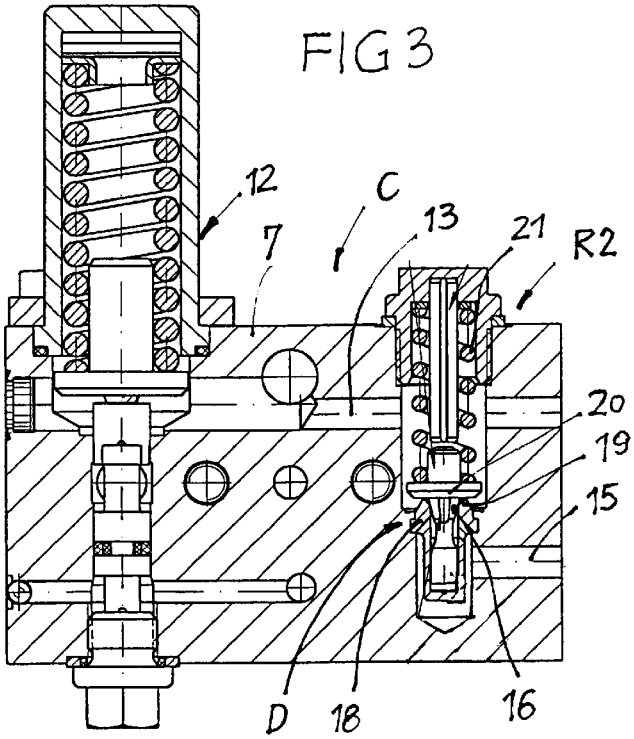
Figure 4:
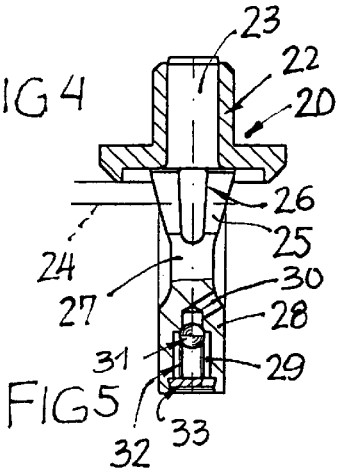
Figure 5:
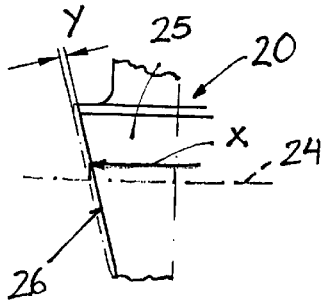
Figure 6:
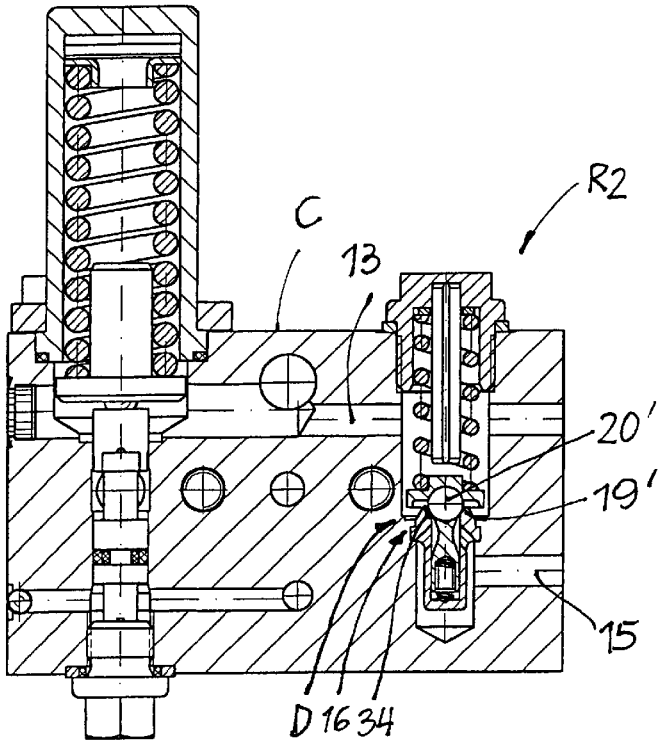

Embodiments of the invention will be explained with the help of the drawing. In the drawing is:

FIG. 1 a schematic side view of an electrohydraulic motor pump aggregate,

FIG. 2 electrohydraulic motor pump aggregate symbolised by a block diagram, also showing a hydraulic consumer, FIG. 3 a longitudinal sectional view of an attachable element of the motor pump aggregate, FIG. 4 a detail in FIG. 3, partially in a sectional view, FIG. 5 a detail of FIG. 4, and FIG. 6 a longitudinal sectional view of another embodiment of an attachable element.

A electrohydraulic motor pump aggregate G (FIG. 1) is used as a supply unit, e.g. of a hydro-mechanic tool. The aggregate G either is installed stationarily or is used as a transportable unit. A housing 1 which simultaneously may form an oil reservoir T, contains an electro-motor M with a fan 2 as the drive source of at least one interiorly provided pump stage P. The electro-motor M may be a rotary current motor, a DC-motor or even, particularly for mobile applications, an AC-motor which can be supplied from the normal electricity net.

An attachable element C is either mounted to the housing 1 or is integrated into the housing 1. The attachable element C is connected with at least one, not shown, pressure side port of the pump stage P and also is connected to the return line 13 ending in the housing 1. The attachable element C in FIG. 1 has a block shaped housing 7 at which a multi-ways control valve 3 with its switching magnet 4 is mounted. One or two or even more consumer ports A, B or 5, 6, are respectively provided at the attachable element C. A hydraulic, automatic pressure relieving device D is associated to the consumer port B or 6, respectively, and preferably is provided in the interior of the attachable element C. By means of the pressure relieving device D the system pressure occurring at least in the electrohydraulic motor pump aggregate G outwardly to the consumer ports A, B is relieved by means of intended leakage, as soon as the electromotor M is switched off. The system pressure even may be relieved up to the hydraulic consumer not shown in FIG. 1.

The block diagram of FIG. 2 illustrates in dash-dotted lines the housing 1 and the housing 7 as well as a hydraulic consumer Z (e.g. a double actuated differential cylinder) for driving a tool, a clamping device, a holding device, or the like, via an actuating element 17. Hydraulic hoses or pipings 8, 9 connect the hydraulic consumer Z with the consumer ports A, B or 5, 6, respectively.

In the embodiment shown it is assumed that the electromotor M is a AC-motor for driving the fan 2 as well as high pressure pump stage P1 delivering a small flow rate as well as a low pressure pump stage P3 delivering a larger flow rate. Both pump stages P1, P3 are supplied from the tank T. Both pump stages P1, P3 are connected to a common pressure line 10. The low pressure pump stage P3 co-operates with a check valve 11 and can be connected to the return line 13 via a switch-over valve which may be a pressure limiting valve pilot controlled from the pressure line 10. The pressure line 10 leads to an inlet of the multiway control valve 3 held by spring force in the shown control position and which can be switched by the switching solenoid into the other control position. In the control position shown, the consumer port B is connected by a working line 15 to the pressure line 10 (return motion or release stroke) while simultaneously the consumer port A is connected to the return line 13 by a working line 14. Consumer port A is pressure relieved. Both working lines 14, 15 are conveyed to the return line by a respective pressure limiting valve R1, R2. The hydraulic automatic pressure relieving device D is formed by a by-pass 16 integrated into the pressure relieving valve R2. Both pressure limiting valves R1, R2 are seated valves which per se would provide a leakage free blocking position. Thanks to the by-pass 16, however, in the blocking position of the pressure limiting valve R2 leakage occurs to the return line 13 by which leakage the system pressure is relieved as soon as the electromotor M has stopped.

The by-pass 16 e.g. is dimensioned such that it generates a leakage between 0.3 and 0.4 liter per minute in case of a pressure of 150 bars (which e.g. may be the response pressure of the pressure limiting valve R2). By this leakage the system pressure is relieved within a few seconds only, e.g. within about 5 seconds.

The pressure relief occurring in this way when the electromotor M has stopped facilitates the later restart of the electromotor M. Moreover, hose couplings or piping couplings between the aggregate and the hydraulic consumer Z can be separated easily. The hydraulic consumer Z even may be moved manually.

FIG. 3 is a longitudinal section of the attachable element C in a section plane in which the switch-over valve 12 and the pressure relieving valve R2 are visible. The pressure relieving valve R2 is installed in a chamber of the housing 7 which chamber intersects without the return line 13 and the working line 15. An insertion element 18 is positioned in the chamber. The insertion element 18 is positioning a valve seat 19 between the return line 13 and the working line 15. A valve cone 20 co-operates with the valve seat 19. The valve cone 20 is actuated by a spring 21 in a direction towards the valve seat 19 and counter to the pressure in the working line 15. The spring 21 is responsible for generating the response pressure of the pressure relieving valve R2. The integrated pressure relieving device D and particularly the by-pass 16 is formed between the valve cone 20 and the valve seat 10, as will be explained with the help of FIGS. 4 and 5.

According to FIG. 4 the valve cone 20 has, e.g., at its large diameter end a coaxial stem 23 allowing to press on a spring retainer 22. The small diameter end section of the valve cone 20 is prolonged by a neck 27 at which a hollow damping piston 28 is provided. A cavity 29 of the damping piston 22 communicates via a channel 30 with the surrounding of the valve cone 20 and contains a ball check valve having a valve ball 31 and a closure spring 32. The lower, openly formed end of the cavity 21 is closed by a plug 33.

The seat surface of the valve cone is a cone jacket 25 co-operating in a seat zone 24 with the valve seat 19. A flat surface 26 is formed in the cone jacket 25 which flat surface defines an interruption of the round cone jacket 25 and forms, in co-operation with the valve seat 19, the by-pass 16.

According to FIG. 5 the flat surface 26 e.g. is a ground surface in the cone jacket 25. The ground surface is at least essentially parallel to the generatrice of the cone. A grinding depth Y of about 2% to 5% of the diameter X of the cone jacket in the seat zone 24 results in a suitable dimension of the by-pass. Alternatively, at least one longitudinally extending notch could be formed instead of the flat surface 26.

FIG. 6 shows an alternative embodiment of the pressure relieving valve R2 which is a seated ball valve having a valve ball 20' co-operating with the valve seat 19'. In this embodiment the by-pass 16 is formed by at least one notch or recess 34 in valve seat 19' for co-operation with the surface of the ball. Principally, using a notch in the valve seat 19', also could be used for a seated cone valve as well.

What is claimed is:

1. Electrohydraulic motor pump aggregate (G), comprising a housing in which an electromotor (M) drives at least one pump stage (P, P1, P3), an attachable element (C) provided between at least one pressure side port of the pump stage and the aggregate oil return line (13) and at least one consumer port (A, B, 5, 6), the attachable element (C) containing at least one pressure limiting valve (R2, R1) constructed as a seated valve located between the consumer port (A, B, 5, 6) and the return line (13), and a multiways control valve (3) between the consumer port and the pressure side port, characterised in that the motor pump aggregate (G) has a hydraulic automatic pressure releasing device (D) which is incorporated into said attachable element (C) and comprises at least one permanently open by-pass (16).

2. Electrohydraulic motor pump aggregate as in claim 1, characterised in that said pressure relieving device (D) is a permanently open by-pass (16) in one of the pressure limiting valves (R1, R2).

3. Electrohydraulic motor pump aggregate as in claim 2, characterised in that the pressure limiting valve (R2) is a seated cone valve having a spring loaded valve cone (20) and a valve seat (19), preferably of conical shape, and that the by-pass (16) is a flat surface (26) in the cone jacket (25) of the valve cone (20), preferably is a ground surface.

4. Electrohydraulic motor pump aggregate as in claim 3, characterised in that the flat surface (26) is parallel to the generatrice of the cone, and that the flat surface (26) preferably, is formed by a ground surface with a grinding depth (Y) of about 2% to 5% of the diameter (X) of the cone jacket in a seat zone (24).

5. Electrohydraulic motor pump aggregate as in claim 3, characterised in that said valve cone (20) has a holding stem (23) for a spring retainer (22) at its large diameter end and a neck portion (27) of smaller diameter than the cone diameter in said seat zone (24) adjacent to the flat surface (26) in said cone jacket, and that a hollow damping piston (28) is provided at said neck portion (27).

6. Electrohydraulic motor pump aggregate as in claim 5, characterised in that a cavity (29) of the damping piston (28) communicates via at least one channel (30) with the outer surroundings and that a ball check valve (31, 32) is provided in said cavity (29).

7. Electrohydraulic motor pump aggregate as in claim 2, characterised in that the said pressure relieving valve (R2) is seated cone valve or a seated ball valve, the valve cone (20) or valve ball (21) of which is pressed by spring loads against a valve seat (19, 19'), and that the by-pass (16) is at least one notch (34) in said valve seat (19').

8. Electrohydraulic motor pump aggregate as in claim 1, characterised in that two consumer ports (A, B, 5, 6) and two pressure limiting valves (R1, R2) adjusted for differing response pressures are provided, and that the by-pass (16) is provided in the pressure limiting valve (R2) for the lower response pressure, preferably is provided in the pressure limiting valve (R2) associated to the consumer port (B)intended for a return stroke or a release stroke of double-sided actuatable hydraulic consumer (Z) connected to said consumer ports (A, B, 5, 6).

9. Electrohydraulic motor pump aggregate as in claim 1, characterised in that said motor pump aggregate (G) contains an AC-motor as said electromotor (M) which AC-Motor drives a dual circuit pump stage comprising at least one high pressure pump stage (P1) and at least one low pressure pump stage (P3), the low pressure pump stage (P3) of which is connected via a switch-over valve (12) to the return line (13), and that the pressure limiting valve (R2) having the by-pass (16) is provided between the multiway control valve (3) located downstream the switch-over valve (12) and one consumer port (B, 6).

10. Electrohydraulic motor pump aggregate as in claim 1, characterised in that said by-pass (16) is dimensioned to provide a leakage of about 0.3 to 0.4 liter per minute at a pressure of 150 bars, preferably for an essentially complete pressure relief within a time period of about 5 seconds.

11. Attachable element (C) to be attached to an electrohydraulic motor pump aggregate (G), said attachable element (C) comprising at least one multiway control valve (3) between at least one pressure side port and a return line (13) and at least one consumer port (A, B, 5, 6), and furthermore a pressure limiting valve (R1, R2) of a seated valve type between said consumer port (A, B, 5, 6) and said return line (13) characterised in that a permanently open by-pass (16) is provided in said pressure limiting valve (R2).

12. Pressure limiting valve (R2) of a seat valve type, particularly of an attachable element (C) which is to be attached to an electrohydraulic motor pump aggregate, said pressure limiting valve comprising a spring loaded valve cone (20) or a valve ball (20') and a valve seat (19, 19') characterised in that the pressure limiting valve (R2) contains a by-pass (16) for generating a permanent leakage flow of a predetermined magnitude in the blocking position of said pressure limiting valve (R2).

* * * * *